US009711273B2

(12) United States Patent
Suzuki et al.

(10) Patent No.: US 9,711,273 B2
(45) Date of Patent: Jul. 18, 2017

(54) INDUCTOR COMPONENT AND METHOD FOR MANUFACTURING THE SAME

(71) Applicant: MURATA MANUFACTURING CO., LTD., Kyoto-fu (JP)

(72) Inventors: Hironori Suzuki, Kyoto-fu (JP); Masaki Kitajima, Kyoto-fu (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 14/735,598

(22) Filed: Jun. 10, 2015

(65) Prior Publication Data

US 2016/0012961 A1 Jan. 14, 2016

(30) Foreign Application Priority Data

Jul. 8, 2014 (JP) ..... 2014-140491

(51) Int. Cl.

| | |
|---|---|
| ***H01F 27/24*** | (2006.01) |
| ***H01F 5/00*** | (2006.01) |
| ***H01F 27/29*** | (2006.01) |
| ***H01F 27/255*** | (2006.01) |
| ***H01F 27/28*** | (2006.01) |
| ***H01F 41/02*** | (2006.01) |

(52) U.S. Cl.

CPC ..... *H01F 27/29* (2013.01); *H01F 27/255* (2013.01); *H01F 27/2804* (2013.01); *H01F 41/02* (2013.01)

(58) Field of Classification Search

CPC .... H01F 27/29; H01F 27/255; H01F 27/2804; H01F 41/02; H01F 3/08

USPC ..... 336/200, 223, 233, 192; 29/602.1

See application file for complete search history.

(56) References Cited

U.S. PATENT DOCUMENTS

| | | | | |
|---|---|---|---|---|
| 2003/0214793 | A1* | 11/2003 | Uchida | H03H 7/0115 361/761 |
| 2008/0130258 | A1* | 6/2008 | Kudo | H01F 27/027 361/811 |
| 2012/0188049 | A1* | 7/2012 | Matsuura | B22F 1/02 |
| 2012/0274432 | A1* | 11/2012 | Jeong | H01F 27/2804 336/192 |
| 2013/0255071 | A1 | 10/2013 | Muneuchi et al. | |

FOREIGN PATENT DOCUMENTS

| | | | |
|---|---|---|---|
| JP | H06-151217 | A | 5/1994 |
| JP | 2011-003761 | A | 1/2011 |
| JP | 2013-211333 | A | 10/2013 |
| JP | 2013-225718 | A | 10/2013 |

OTHER PUBLICATIONS

An Office Action; "Notice of Reasons for Rejection," issued by the Japanese Patent Office on Dec. 27, 2016, which corresponds to Japanese Patent Application No. 2014-140491 and is related to U.S. Appl. No. 14/735,598; with English language translation.

* cited by examiner

*Primary Examiner* — Mangtin Lian

(74) *Attorney, Agent, or Firm* — Studebaker & Brackett PC

(57) ABSTRACT

In an inductor component, fallen-off-filler marks that are formed as a result of a filler falling off from an outer surface of a component body are present in a dotted manner in portions of the outer surface that are in contact with outer electrodes. As a result of the filler falling off, a joining area at interfaces between the component body and the outer electrodes increases, and stress generated at the interfaces between the component body and the outer electrodes is reduced.

9 Claims, 11 Drawing Sheets

| CUTTING SPEED mm/s | CUT SURFACE | CUTTING SPEED mm/s | CUT SURFACE |
|---|---|---|---|
| 3 |  | 30 |  |
| 10 |  | 40 |  |
| 20 |  | 50 |  |

INDUCTOR COMPONENT AND METHOD FOR MANUFACTURING THE SAME

CROSS REFERENCE TO RELATED APPLICATIONS

This application claims benefit of priority to Japanese Patent Application No. 2014-140491 filed Jul. 8, 2014, the entire content of which is incorporated herein by reference.

TECHNICAL FIELD

The present disclosure relates to inductor components and a method for manufacturing the inductor components. More particularly, the present disclosure relates to an inductor component in which a resin containing a magnetic powder dispersed therein is used as a material of a component body, in which an inductor conductor is embedded, and a method for manufacturing the inductor component.

BACKGROUND

An inductor component related to the present disclosure is described in, for example, Japanese Unexamined Patent Application Publication No. 2011-3761. Japanese Unexamined Patent Application Publication No. 2011-3761 describes a winding-integrated type molded coil that has a configuration in which a winding serving as an inductor conductor is embedded in a component body that is formed by molding a magnetic material containing a metallic magnetic powder and a resin. An outer electrode that is included in this coil is electrically connected to the winding and formed on an outer surface of the component body.

Unlike a coil in which ferrite is used as a magnetic material, such a coil that is manufactured by performing resin molding will not receive a relatively large heat load through firing or the like in a process of manufacturing the coil, and thus, a problem of material deterioration will rarely occur during the process of manufacturing the coil.

However, on the other hand, when an outer electrode is formed, a baking method that has hitherto been used cannot be used because, in the baking method, a high temperature that adversely affects a resin, out of which a component body is made, needs to be applied to the component body. Therefore, when the outer electrode is formed, for example, a conductive paste containing a thermosetting resin in which a conductive metallic powder is dispersed is applied on the component body and cured at a relatively low temperature.

This may sometimes result in a problem of insufficient joint strength of the outer electrode with respect to the component body. Therefore, when the inductor component is subjected to a heat load cycle in a state of being mounted on a substrate, the degree of close contact between the outer electrode and the component body may sometimes deteriorate, and separation of the outer electrode from the component body at an interface between the outer electrode and the component body may sometimes occur.

SUMMARY

Accordingly, it is an object of the present disclosure to provide an inductor component capable of suppressing separation of an outer electrode from a component body and a method for manufacturing the inductor component.

According to a preferred embodiment of the present disclosure, there is provided an inductor component including a component body that has a substantially rectangular parallelepiped shape, which is defined by first and second main surfaces opposing each other, first and second side surfaces opposing each other, and first and second end surfaces opposing each other, and that includes a resin and a filler dispersed in the resin, an inductor conductor embedded in the component body, and outer electrodes that are electrically connected to the inductor conductor and that are formed on an outer surface of the component body. Fallen-off-filler marks formed as a result of the filler falling off from the outer surface of the component body are present in a dotted manner in portions of the outer surface that are in contact with the outer electrodes.

As a result of the filler falling off, a joining area at interfaces between the component body and the outer electrodes increases, and stress generated at the interfaces between the component body and the outer electrodes is reduced.

In the inductor component according to the preferred embodiment of the present disclosure, it is preferable that an area percentage of the fallen-off-filler marks in the portions of the outer surface of the component body, which are in contact with the outer electrodes, be about 10% or higher and about 80% or lower. With this configuration, undesirable deterioration of the magnetic property due to an excessive amount of the filler that falls off can be prevented while sufficiently realizing the above-mentioned advantageous effect of reducing the stress.

In the preferred embodiment, an end portion of the inductor conductor is extended to one of the first and second end surfaces of the component body, and at least a portion of each of the outer electrodes is formed on at least a portion of one of the first and second end surfaces. In this case, it is preferable that an area percentage of the fallen-off-filler marks in the first and second end surfaces be higher than an area percentage of the fallen-off-filler marks in the first and second main surfaces and an area percentage of the fallen-off-filler marks in the first and second side surfaces because the amount of the filler that falls off in the first and second main surfaces and in the first and second side surfaces and that does not particularly contribute to improvement of the degree of close contact between the outer electrodes and the component body can be reduced, so that undesirable deterioration of the magnetic property can be suppressed, and the amount of the filler that falls off in the first and second end surfaces can be further increased, so that the degree of close contact between the outer electrodes and the component body can be effectively improved.

In addition, it is preferable that a first edge portion of each of the outer electrodes be located on one of the first and second end surfaces, a second edge portion of each of the outer electrodes be located on the second main surface, and each of the outer electrodes be formed in such a manner as to extend from one of the first and second end surfaces to the second main surface. To put it simply, it is preferable that each of the outer electrodes be formed in such a manner as to extend from one of the first and second end surfaces to the second main surface so as to have a substantially L shape. This configuration is particularly advantageous to an inductor component that includes a component body whose height is reduced.

In the above configuration, it is preferable that, when one of the first and second end surfaces is divided into two regions by an imaginary separation line, which is parallel to the first and second main surfaces, an area percentage of the fallen-off-filler marks in a divided region adjacent to the first main surface be higher than an area percentage of the fallen-off-filler marks in a divided region adjacent to the second main surface. It was confirmed by an experiment that, in the case where each of the outer electrodes extended so as to have a substantially L shape from one of the first and second end surfaces to the second main surface, when the inductor component was mounted on a substrate, the largest tensile stress was generated in the vicinities of the first edge portions of the outer electrodes located on the first and second end surfaces. In other words, regarding the tensile stress generated by the outer electrodes, that is, the tensile stress in a direction perpendicular to the first and second end surfaces, it was confirmed that, in the case where one of the first and second end surfaces was divided into two regions by the imaginary separation line, which was parallel to the first and second main surfaces, the tensile stress that acted on the divided region adjacent to the first main surface was larger than the tensile stress that acted on the divided region adjacent to the second main surface. Therefore, as described above, by setting the area percentage of the fallen-off-filler marks in the divided region adjacent to the first main surface to be higher than the area percentage of the fallen-off-filler marks in the divided region adjacent to the second main surface, the degree of close contact between the outer electrodes and the component body in the vicinities of the first edge portions of the outer electrodes in each of which the largest tensile stress is generated, the first edge portions of the outer electrodes being located on the first and second end surfaces, can be effectively improved. On the other hand, in a region in which a relatively small tensile stress is generated, the amount of the filler that falls off is reduced, so that deterioration of the magnetic property is suppressed.

According to another preferred embodiment of the present disclosure, there is provided a method for manufacturing the above-described inductor component.

The method for manufacturing the inductor component according to the other preferred embodiment of the present disclosure includes fabricating an aggregate component body that includes a plurality of the component bodies for a plurality of the inductor components, the plurality of component bodies including the inductor conductors embedded in the component bodies and being integrated with one another in a state where the first main surfaces of the component bodies are arranged on one plane and the second main surfaces of the component bodies are arranged on another plane, dividing the aggregate component body in order to obtain the individual component bodies, and forming the outer electrodes by using a conductive paste containing a resin in which a conductive metallic powder is dispersed.

The dividing of the aggregate component body includes dividing the aggregate component body in such a manner that at least the first and second end surfaces of the component bodies appear, and in the dividing the aggregate component body, the filler is caused to fall off, so that fallen-off-filler marks, which are formed as a result of the filler falling off, are formed in the first and second end surfaces of the component bodies.

In the method for manufacturing the inductor component according to the other preferred embodiment of the present disclosure, it is preferable that the dividing of the aggregate component body include performing half cutting on the aggregate component body by using a dicer while leaving a portion of the aggregate component body in a thickness direction of the aggregate component body, and it is preferable that the forming of the outer electrodes include applying the conductive paste onto the aggregate component body on which the half cutting has been performed. With this configuration, the applying of the conductive paste for forming the outer electrodes can be efficiently performed.

It is preferable that a speed of the half cutting using the dicer be set to be 30 mm/s or higher. By setting the speed of the half cutting using the dicer to be 30 mm/s or higher, as described above, a configuration in which, when one of the first and second end surfaces is divided into two regions by an imaginary separation line, which is parallel to the first and second main surfaces, an area percentage of the fallen-off-filler marks in a divided region adjacent to the first main surface is higher than an area percentage of the fallen-off-filler marks in a divided region adjacent to the second main surface can easily be realized.

According to the preferred embodiments of the present disclosure, as a result of a filler falling off, stress generated at interfaces between a component body and outer electrodes is reduced, and a joining area at the interfaces between the component body and the outer electrodes is increased, so that joint strengths of the outer electrodes with respect to the component body can be improved. Therefore, even if an inductor component is subjected to a heat load cycle in a state of being mounted on a substrate, the degree of close contact between the outer electrodes and the component body is less likely to deteriorate, and accordingly, separation of the outer electrodes from the component body at the interfaces between the outer electrodes and the component body can be suppressed.

Other features, elements, characteristics and advantages of the present disclosure will become more apparent from the following detailed description of preferred embodiments of the present disclosure with reference to the attached drawings.

DETAILED DESCRIPTION

A configuration of an inductor component 1 according to a first embodiment of the present disclosure will be described mainly with reference to FIG. 1.

Figure 2A:
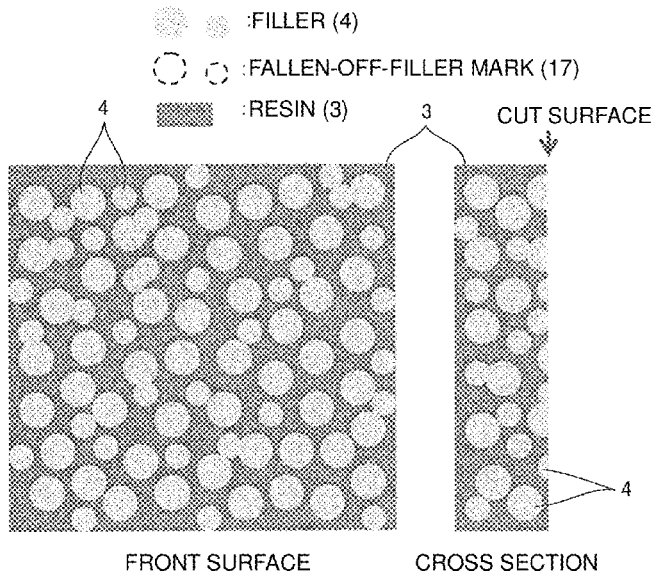
FIGS. 2A and 2B are diagrams illustrating fallen-off-filler states of a filler, which is one of the features of the present disclosure, FIG. 2A schematically illustrating a state where the filler has not fallen off, and FIG. 2B schematically illustrating a state where the filler has fallen off.
Figure 2B:
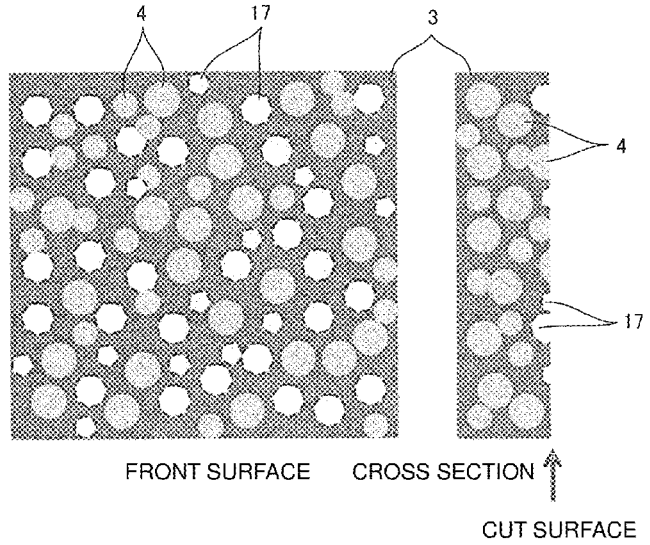

The inductor component 1 includes a component body 2. As illustrated in FIGS. 2A and 2B, the component body 2 includes a resin 3 and a filler 4 dispersed in the resin 3. Although, for example, a metallic magnetic powder, such as Fe—Si—Cr alloy powder or carbonyl iron powder, may preferably be used as the filler 4, a ferrite powder may be used as the filler 4 in the case where the inductor component 1 is used for, for example, high-frequency applications. As the resin 3, for example, an epoxy-based resin is used.

A specific example of the material of the component body 2 is a material formed by adding about 0.1 wt % of a silane coupling agent to a mixture containing, for example, about 96 wt % of amorphous magnetic powder, which has an average particle diameter of about 30 μm, and about 4 wt % of an epoxy resin mixture of a novolac-type epoxy resin and a phenolic novolac-type epoxy resin in equal proportions.

The component body 2 has a substantially rectangular parallelepiped shape defined by first and second main surfaces 5 and 6 opposing each other, first and second side surfaces 7 and 8 opposing each other (see FIG. 7), and first and second end surfaces 9 and 10 opposing each other.

Inductor conductor 11 each of which contains, for example, copper as a main component are embedded in the component body 2. Although not illustrated in detail, the inductor conductor 11 typically extends so as to have a substantially coil shape. The component body 2, in which the inductor conductor 11 is embedded, is manufactured by using, for example, a technique for stacking a resin sheet and a metal foil, such as a copper foil, a photolithography technique for patterning a metal foil, and the like. Note that the inductor conductor 11 may be a member extending in, for example, a helical manner on one plane or a conductor formed in a substantially coil shape.

Although it is preferable that the entire component body 2 be made of the resin 3 containing the filler 4, which is made of a magnetic material, in the component body 2, only portions that form at least an internal magnetic path and an external magnetic path of the inductor conductor 11, which extends so as to have a substantially coil shape, may be made of the resin 3 containing the filler 4, which is made of a magnetic material, and a portion positioned between the inductor conductor 11 each having a multilayer structure may be made of a resin containing a filler, which is not a magnetic material, or a resin that does not contain a filler.

First and second outer electrodes 13 and 14 that are electrically connected to the inductor conductor 11 are formed on an outer surface of the component body 2. More specifically, an end portion of the inductor conductor 11 is extended to one of the first and second end surfaces 9 and 10, and at least a portion of the first outer electrode 13 and at least a portion of the second outer electrode 14 are respectively formed on at least a portion of the first end surface 9 and at least a portion of the second end surface 10. In particular, in the first embodiment, a first edge portion of the first outer electrode 13 and a first edge portion of the second outer electrode 14 are respectively located on the first end surface 9 and the second end surface 10, and second edge portions of the first and second outer electrodes 13 and 14 are located on the second main surface 6. The first outer electrode 13 is formed in such a manner as to extend so as to have a substantially L shape from the first end surface 9 to a portion of the second main surface 6, and the second outer electrode 14 is formed in such a manner as to extend so as to have a substantially L shape from the second end surface 10 to a portion of the second main surface 6.

The first and second outer electrodes 13 and 14 are formed by applying and curing a conductive paste made of a resin such as, for example, an epoxy-based resin in which a conductive metallic powder such as, for example, a silver powder is dispersed.

A plating film 15 and a plating film 16 are respectively formed on the first outer electrode 13 and the second outer electrode 14 as necessary. It is preferable that each of the plating films 15 and 16 have a two-layer structure formed of a nickel-plated film and a tin-plated film.

One of the features of the present disclosure is that, in the inductor component 1 having the above configuration, fallen-off-filler marks 17 that are formed as a result of the filler 4 falling off from the outer surface of the component body 2 are present in a dotted manner in at least portions of the outer surface each of which is in contact with one of the first and second outer electrodes 13 and 14. FIG. 2A illustrates a state where the filler 4 has not fallen off, and FIG. 2B illustrates a state where the filler 4 has fallen off, that is, a state where the fallen-off-filler marks 17 are present in a dotted manner. In the first embodiment, the fallen-off-filler marks 17, which are formed as a result of the filler 4 falling off, are present in a dotted manner in at least the first and second end surfaces 9 and 10 of the component body 2.

The presence of the fallen-off-filler marks 17 enables stress generated at an interface between the component body 2 and the first outer electrode 13 and at an interface between the component body 2 and the second outer electrode 14 to be reduced and a joint area at the interface between the component body 2 and the first outer electrode 13 and a joint area at the interface between the component body 2 and the second outer electrode 14 to be increased, so that joint strengths of the first and second outer electrodes 13 and 14 with respect to the component body 2 are improved.

Figure 3:
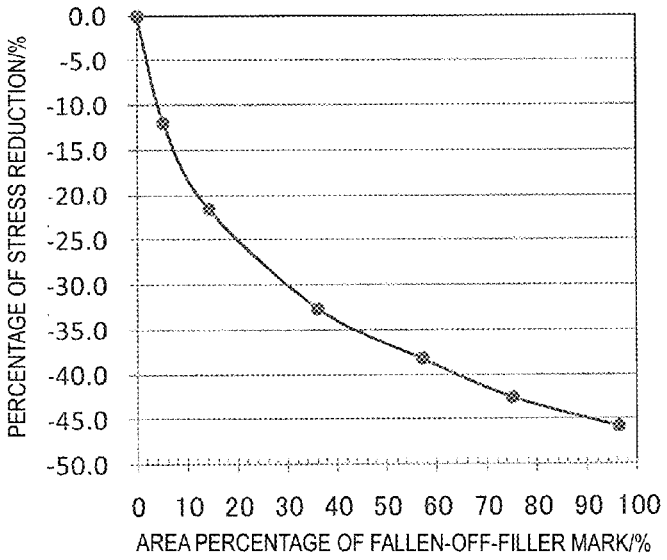
FIG. 3 is a graph representing a relationship between an area percentage of fallen-off-filler marks of the filler in a surface of a component body, which is in contact with an outer electrode, and a reduction percentage of stress generated at an interface between the outer electrode and the component body, the area percentage and the reduction percentage being determined by an analysis simulation.

An analysis simulation was performed in order to recognize a relationship between an area percentage of the fallen-off-filler marks 17 of the filler 4 in the surface of the component body 2, which is in contact with the first outer electrode 13, and in the surface of the component body 2, which is in contact with the second outer electrode 14, and a reduction percentage of stress generated at the interface between the first outer electrode 13 and the component body 2 and at the interface between the second outer electrode 14 and the component body 2. FIG. 3 is a graph representing a relationship between an area percentage of the fallen-off-filler marks 17 and a reduction percentage of the stress each of which is determined by the analysis simulation.

For example, an area percentage of the fallen-off-filler marks 17 is calculated as below. A field of view of about 500 μm×about 500 μm is defined in a region in which an area percentage of the fallen-off-filler marks 17 is to be determined, and an image of the field of view is captured by using a microscope. Then, the ratio of the area of the fallen-off-filler marks 17 to a total site area of the filler 4 and the fallen-off-filler marks 17 that are present in the entire captured image of the field of view is calculated. Then, the above ratios in four samples in the same manufacturing lot are evaluated, and the average value of the four ratios is set as the area percentage of the fallen-off-filler marks 17. Here, for example, "A-zou kun" (Registered Trademark) manufactured by Asahi Kasei Engineering Corporation can be used as an image analysis software.

As illustrated in FIG. 3, it was confirmed that the stress at the interfaces is reduced by increasing the area percentage of the fallen-off-filler marks 17 compared with the case where the area percentage of the fallen-off-filler marks 17 is about 0%. Considering the amount of reduction in the degree of close contact between the first and second outer electrodes 13 and 14 and the component body 2 in the case where a baking method of the related art is employed, the reduction percentage of the stress at the interfaces is required to be an absolute value of at least about 15% or higher (about −15% or lower), and accordingly, it is preferable that the area percentage of the fallen-off-filler marks 17 be about 10% or higher.

As described above, it is preferable that the area percentage of the fallen-off-filler marks 17 be high in order to reduce the stress at the interfaces. On the other hand, there is a concern that the magnetic property is more likely to deteriorate, that is, the inductance is more likely to decrease as the amount of the filler 4 that falls off increases.

Figure 4:
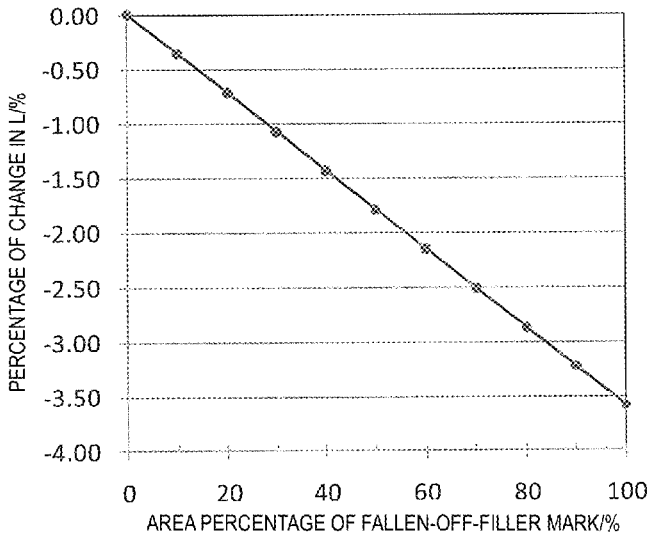
FIG. 4 is a graph representing a relationship between an area percentage of fallen-off-filler marks of the filler in the surface of the component body, which is in contact with the outer electrode, and a percentage of change in an inductance, the area percentage and the percentage of change being determined by an analysis simulation.

FIG. 4 is a graph representing a relationship between an area percentage of the fallen-off-filler marks 17 of the filler 4 in the surface of the component body 2, which is in contact with the first outer electrode 13, and in the surface of the component body 2, which is in contact with the second outer electrode 14, and a percentage of change in the inductance (L value), the area percentage and the percentage of change being determined by an analysis simulation.

It can be confirmed from FIG. 4 that the L value decreases as the amount of the filler 4 that falls off increases. Considering a product specification, it is preferable that an upper limit of the area percentage of the fallen-off-filler marks 17 be about 80% in order to keep an acceptable percentage of change (percentage of decrease) in the L value within about −3.0%.

It is understood from results of the above simulation that it is preferable that the area percentage of the fallen-off-filler marks 17 in the portions of the outer surface of the component body 2, which are in contact with the first and second outer electrodes 13 and 14, be about 10% or higher and about 80% or lower.

A preferred method for manufacturing the inductor component 1 will now be described.

Figure 5:
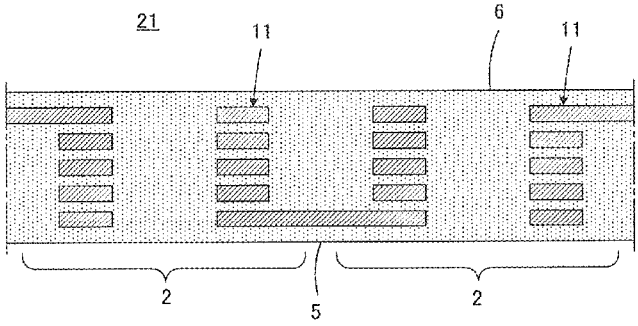
FIG. 5 is a diagram illustrating a method for manufacturing the inductor component illustrated in FIG. 1 and is a sectional view of a portion of an aggregate component body from which a plurality of component bodies can be obtained.

First, as illustrated in FIG. 5, an aggregate component body 21 that includes a plurality of component bodies 2 for a plurality of inductor components 1, the plurality of component bodies 2 including the inductor conductors 11 embedded therein and being integrated with one another in a state where the first main surfaces 5 of the component bodies 2 are arranged on one plane and the second main surfaces 6 of the component bodies 2 are arranged on one plane, is fabricated. When the aggregate component body 21 is fabricated, the technique for stacking a resin sheet and a metal foil, such as a copper foil, the photolithography technique for patterning a metal foil, and the like, which have been described above as the exemplary methods of fabricating the component body 2, are used. In FIG. 5 to FIG. 10, components corresponding to the components illustrated in FIG. 1 are denoted by similar reference numerals, and repeated descriptions will be omitted. Note that, in FIG. 5 to FIG. 10, each of the component bodies 2 is illustrated by turning its representation illustrated in FIG. 1 upside down.

Figure 6:
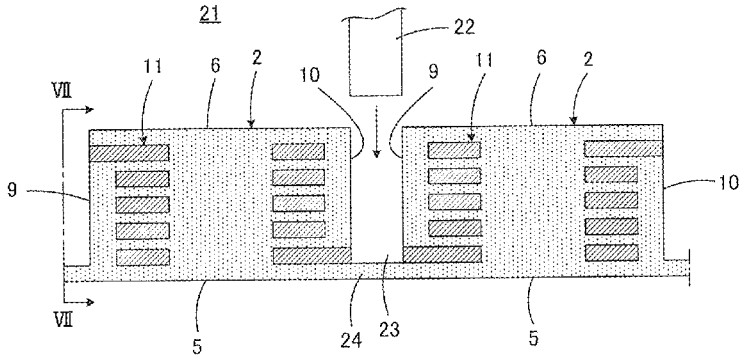
FIG. 6 is a sectional view illustrating a state where a half-cutting operation has been performed on the aggregate component body illustrated in FIG. 5 by using a dicer.

Next, as illustrated in FIG. 6, as part of a dividing process for obtaining the individual component bodies 2, a half-cutting operation is performed on the aggregate component body 21 by using a dicer. FIG. 6 schematically illustrates a blade 22 of the dicer and illustrates grooves 23 that are formed by the half-cutting operation and connecting portions 24, which remain after the grooves 23 have been formed and each of which has a relatively small thickness. The first and second end surfaces 9 and 10 of the component bodies 2 appear as a result of the formation of the grooves 23, and end portions of the inductor conductors 11 that will serve as extended portions are exposed at the first and second end surfaces 9 and 10, which appear as described above.

It is preferable that the above-described fallen-off-filler marks 17, which are formed as a result of the filler 4 falling off, be formed in a dicer-cutting operation, which is the above-described half-cutting operation using the dicer. It is obvious that the fallen-off-filler marks 17 may be formed in another process that is subsequent to the dividing process, and in the other process, either of mechanical processing, such as processing using a grinder, and chemical processing, such as etching, can be used.

When the fallen-off-filler marks 17 are formed by performing the dicer cutting, the cutting speed, the rotational speed of the blade 22, the degree of concentration and the shapes of abrasive grains of the blade 22, and the like are suitably selected. As an example, it was confirmed that, in the case where the dicer cutting was performed under conditions of a cutting speed of 10 mm/s to 40 mm/s and a grain size of the abrasive grains of the blade 22 of #600 to #800, an area percentage of the fallen-off-filler marks 17 of 10% or higher and 80% or lower was obtained.

A process of dividing an aggregate component body is also described in Japanese Unexamined Patent Application Publication No. 2011-3761, which has been mentioned above. However, as described in [0030], [0060], and [0061] of Japanese Unexamined Patent Application Publication No. 2011-3761, a method of "cutting using a rotary blade on which diamond grains are applied", that is, dicer cutting, is not employed, and instead of dicer cutting, the following methods are suggested: a method that employs compression molding when the aggregate component body is formed in order to form grooves for dividing the aggregate component body, a method that uses, as powder that is jetted out in sandblasting or the like, a material having a hardness smaller than that of a filler, a method that uses a pressing blade in a state where a resin is softened, a method that uses high-pressure water, a laser cutting method in which only a resin is selectively decomposed or degraded, and the like. These methods suggested in Japanese Unexamined Patent Application Publication No. 2011-3761 substantially do not cause the filler to fall off.

Returning to FIG. 1, it was confirmed by an experiment that, in the case where the first outer electrode 13 extended so as to have a substantially L shape from the first end surface 9 to the second main surface 6, and the second outer electrode 14 extended so as to have a substantially L shape from the second end surface 10 to the second main surface 6, when the inductor component 1 was mounted on a substrate (not illustrated) in such a manner that the second main surface 6 faced the substrate, the largest tensile stress was generated in the vicinities of the first edge portion of the first outer electrode 13 located on the first end surface 9 and the first edge portion of the second outer electrode 14 located on the second end surface 10. Note that, since the first end surface 9 and the second end surface 10 have substantially the same configuration, the first end surface 9 illustrated in FIG. 7 will be described below, and the second end surface 10 relies on the description of the first end surface 9.

Figure 7:
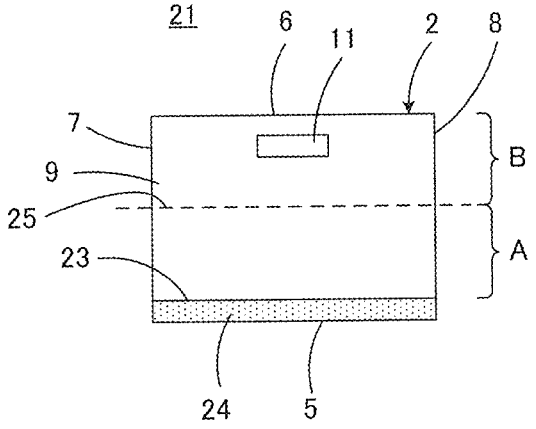
FIG. 7 is a sectional view taken along line VII-VII of FIG. 6 illustrating a fallen-off-filler state of the filler in an end surface of the component body after the half-cutting operation illustrated in FIG. 6.

According to a distribution state of the above-mentioned tensile stress, in the case where the first end surface 9 illustrated in FIG. 7 is divided into two regions by an imaginary separation line 25 that is parallel to the first and second main surfaces 5 and 6, the tensile stress that acts on a divided region A adjacent to the first main surface 5 is larger than the tensile stress that acts on a divided region B adjacent to the second main surface 6. In order to match this, in the first embodiment, on the basis of the relationship between an area percentage of the fallen-off-filler marks 17 and a reduction percentage of stress, which is illustrated in FIG. 3, the area percentage of the fallen-off-filler marks 17 in the divided region A adjacent to the first main surface 5 is set to be higher than the area percentage of the fallen-off-filler marks 17 in the divided region B adjacent to the second main surface 6.

As a result, the degree of close contact between the first outer electrode 13 and the component body 2 in the vicinity of the first edge portion of the first outer electrode 13 in which the largest tensile stress is generated, the first edge portion of the first outer electrode 13 being located on the first end surface 9, can be effectively improved, and, on the other hand, in a region in which a relatively small tensile stress is generated, the amount of the filler 4 that falls off is reduced, so that a desired magnetic property is ensured.

A configuration in which the area percentage of the fallen-off-filler marks 17 in the divided region A adjacent to the first main surface 5 is set to be higher than the area percentage of the fallen-off-filler marks 17 in the divided region B adjacent to the second main surface 6 in the first end surface 9 as described above is advantageously realized by controlling the cutting speed of the half-cutting using the dicer illustrated in FIG. 6 as will be described below.

Figure 8:
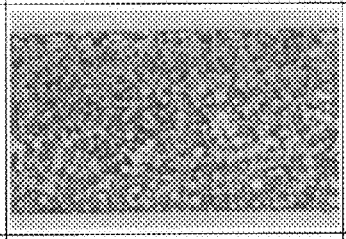
FIG. 8 is a diagram illustrating images of cut surfaces that are captured by a microscope, the cut surfaces being obtained in an experiment in which dicer-cutting operations illustrated in FIG. 6 were performed at various cutting speeds.
Figure 8:
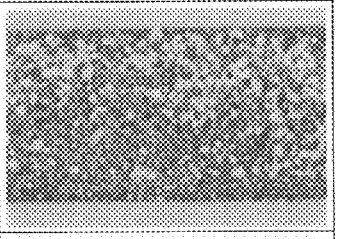
Figure 8:
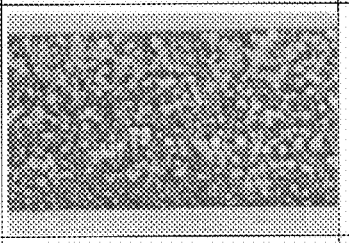
Figure 8:
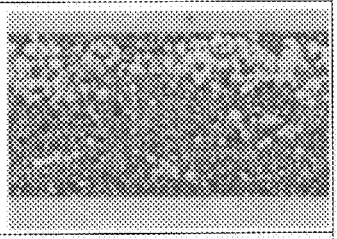
Figure 8:
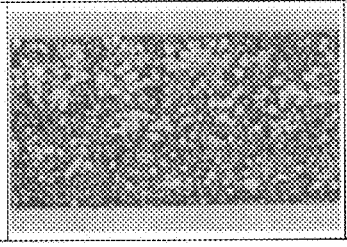
Figure 8:
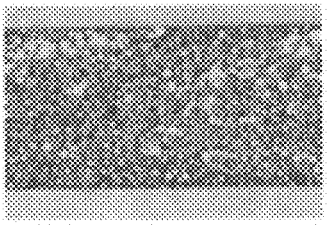

FIG. 8 is a diagram illustrating images of cut surfaces captured by a microscope, the cut surfaces being obtained in an experiment in which the dicer-cutting operations were performed at various cutting speeds. FIG. 8 illustrates captured images each corresponding to the "front surface" illustrated in FIGS. 2A and 2B. In FIG. 8, particulate matter that appears to be whitish is the metallic magnetic powder, which serves as the filler 4. Thus, when the filler 4, which appears to be whitish, falls off, a base surface that appears to be blackish is exposed, and accordingly, blackish parts in FIG. 8 are the fallen-off-filler marks 17. In addition, the top and bottom of each of the captured images illustrated in FIG. 8 match the top and bottom of the first end surface 9 illustrated in FIG. 7.

It is understood from FIG. 8 that, in the cut surfaces, the distribution states of the filler 4 and the fallen-off-filler marks 17 vary in accordance with changes in the cutting speed. In other words, the filler 4 and the fallen-off-filler marks 17 are distributed approximately uniformly over the entire cut surfaces under a condition of the cutting speed of 3 mm/s to 20 mm/s, that is, a relatively low cutting speed. On the other hand, under a condition of the cutting speed of 30 mm/s or higher, that is, a relatively high cutting speed, as the cutting speed increases, the fallen-off-filler marks 17 become more likely to be generated on the lower half side of the cut surfaces.

A possible cause of this phenomenon is as follows. Processing chips are less likely to be discharged on the lower side of each of the cut surfaces than on the upper side of the cut surface, and thus, the blade 22 is brought into a state as if the blade 22 is clogged. When the blade 22 continues cutting regardless of its deteriorated cutting ability, only an external force is applied to the filler 4, and as a result, the filler 4 falls off before the aggregate component body 21 is cut. This tendency becomes notable as the cutting speed increases.

It can be understood from the experimental results illustrated in FIG. 8 that, by setting the speed of the half cutting using the dicer to be 30 mm/s or higher, the area percentage of the fallen-off-filler marks 17 in the divided region A adjacent to the first main surface 5 can advantageously be set to be higher than the area percentage of the fallen-off-filler marks 17 in the divided region B adjacent to the second main surface 6 in the first end surface 9 illustrated in FIG. 7 as described above.

Figure 9:
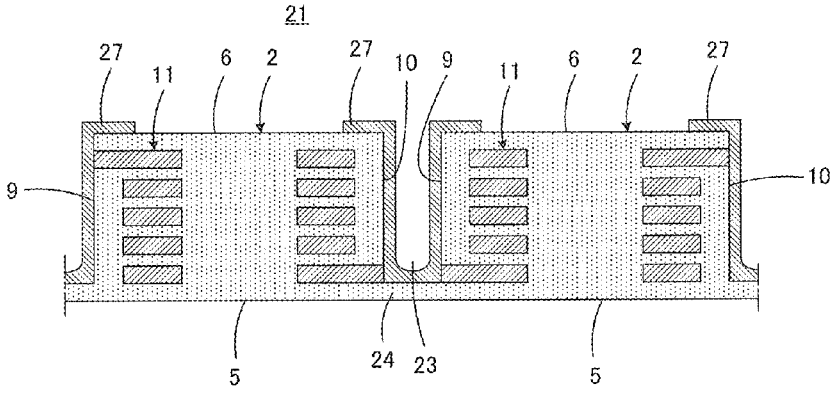
FIG. 9 is a sectional view illustrating a state where an outer-electrode-formation process using a conductive paste has been performed on the aggregate component body after the half-cutting operation illustrated in FIG. 6.

Next, as illustrated in FIG. 9, a process of forming the first and second outer electrodes 13 and 14 by using a conductive paste 27 containing a resin in which a conductive metallic powder is dispersed is performed. More specifically, the conductive paste 27 is applied to inner wall surfaces of the grooves 23 formed in the aggregate component body 21 by the half cutting, and then, the applied conductive paste 27 is cured. The conductive paste 27, which is cured in this manner, provides the first and second outer electrodes 13 and 14.

Next, in order to obtain the plurality of component bodies 2 for the individual inductor components 1 from the aggregate component body 21, the aggregate component body 21 is completely divided along the grooves 23, and at least portions of the connecting portions 24 are removed. In this case, any one of cutting methods including dicer cutting or chocolate breaking that is a method for dividing the aggregate component body 21 by breaking the aggregate component body 21 along the grooves 23 may be employed.

Note that, although not illustrated in FIG. 6, FIG. 7, and FIG. 9, in the case where the aggregate component body 21 has a configuration in which the plurality of component bodies are arranged in row and column directions, after the conductive paste 27, which will become the first and second outer electrodes 13 and 14, has been applied and cured as illustrated in FIG. 9, a cutting operation in a direction perpendicular to the direction in which the grooves 23 extend is performed. Although the first and second side surfaces 7 and 8 of the component bodies 2 appear by performing the cutting operation in the direction perpendicular to the direction in which the grooves 23 extend, from the standpoint of suppressing deterioration of the magnetic property, it is preferable that the filler 4 does not fall off in the first and second side surfaces 7 and 8. Therefore, for example, cutting methods, excluding dicer cutting, such as laser cutting, sandblasting, and ultrasonic cutting may be employed in the cutting operation in the direction perpendicular to the direction in which the grooves 23 extend.

Figure 10:
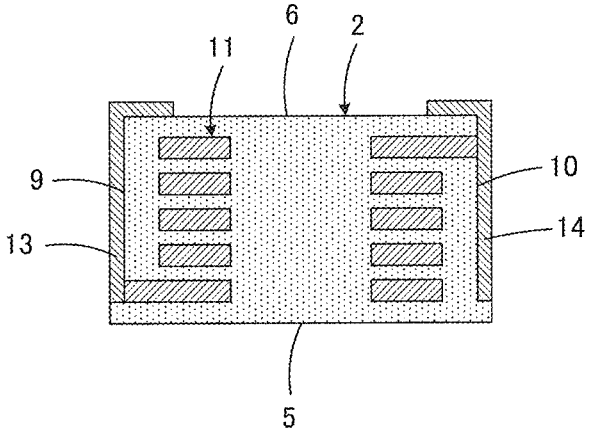
FIG. 10 is a sectional view of one of component bodies for the individual inductor components, the component body being obtained by dividing the aggregate component body illustrated in FIG. 9.

FIG. 10 illustrates one of the component bodies 2 obtained by dividing the aggregate component body 21. In the component body 2, which has been obtained by dividing the aggregate component body 21, the first edge portion of the first outer electrode 13 and the first edge portion of the second outer electrode 14 are respectively located on the first end surface 9 and the second end surface 10, and the second edge portions of the first and second outer electrodes 13 and 14 are located on the second main surface 6. The first outer electrode 13 is formed in such a manner as to extend from the first end surface 9 to a portion of the second main surface 6, and the second outer electrode 14 is formed in such a manner as to extend from the second end surface 10 to a portion of the second main surface 6. According to the above-described manufacturing method, in the individual component body 2 obtained by dividing the aggregate component body 21, the area percentage of the fallen-off marks 17 of the filler 4 in the first and second end surfaces 9 and 10 is higher than the area percentage of the fallen-off marks 17 of the filler 4 in the first and second main surfaces 5 and 6 and the area percentage of the fallen-off marks 17 of the filler 4 in the first and second side surfaces 7 and 8.

Figure 1:
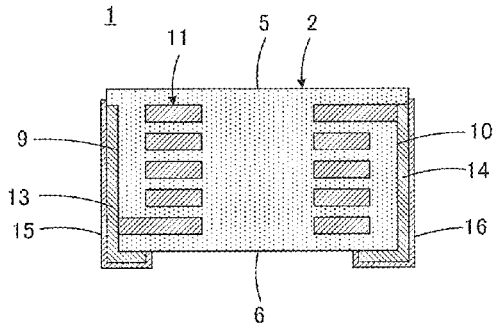
FIG. 1 is a sectional view of an inductor component according to a first embodiment of the present disclosure.

Next, the plating film 15 and the plating film 16 are respectively formed on the first outer electrode 13 and the second outer electrode 14 as necessary, and the inductor component 1 illustrated in FIG. 1 is completed.

Figure 11:
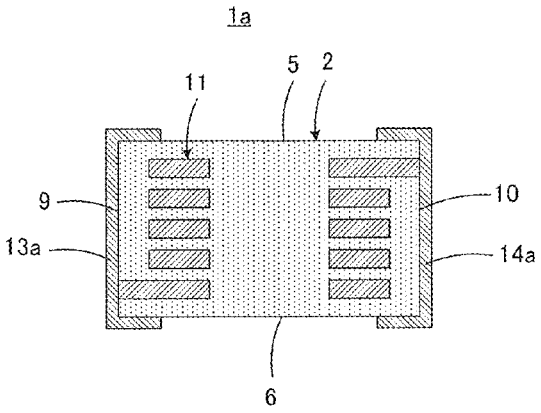
FIG. 11 is a sectional view of an inductor component according to a second embodiment of the present disclosure.

FIG. 11 illustrates an inductor component 1*a* according to a second embodiment of the present disclosure. In FIG. 11, components corresponding to the components illustrated in FIG. 1 are denoted by similar reference numerals, and repeated descriptions will be omitted.

In the inductor component 1*a* illustrated in FIG. 11, regions in which outer electrodes 13*a* and 14*a* are formed are different from the regions in which the first and second outer electrodes 13 and 14 are formed in the inductor component 1 illustrated in FIG. 1. In the inductor component 1*a*, the outer electrode 13*a* is formed on a first end surface 9 of a component body 2 and formed in such a manner as to extend from the first end surface 9 to portions of first and second main surfaces 5 and 6 and portions of first and second side surfaces 7 and 8 (see FIG. 7), and the outer electrode 14*a* is formed on a first end surface 10 of the component body 2 and formed in such a manner as to extend from the first end surface 10 to portions of the first and second main surfaces 5 and 6 and portions of the first and second side surfaces 7 and 8 (see FIG. 7).

When the inductor component 1*a* that includes the outer electrodes 13*a* and 14*a*, which have been described above, is manufactured, a process of applying a conductive paste for the outer electrodes 13*a* and 14*a* is usually performed after an aggregate component body 21 is divided into the individual component bodies 2. When the process of applying the conductive paste is performed, for example, a dip method is employed.

Note that, although not illustrated in FIG. 11, a plating film may be formed on each of the outer electrodes 13*a* and 14*a* as necessary.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An inductor component comprising:

a component body having a substantially rectangular parallelepiped shape, is the component body being defined by first and second main surfaces opposing each other, first and second side surfaces opposing each other, and first and second end surfaces opposing each other, and including a resin and a filler dispersed in the resin;

an inductor conductor embedded in the component body; and outer electrodes electrically connected to the inductor conductor and formed on an outer surface of the component body, wherein fallen-off-filler marks formed as a result of the filler falling off from the outer surface of the component body are present in a dotted manner in portions of the outer surface that are in contact with the outer electrodes.

2. The inductor component according to claim 1, wherein an area percentage of the fallen-off-filler marks in the portions of the outer surface of the component body, which are in contact with the outer electrodes, is about 10% or higher and about 80% or lower.

3. The inductor component according to claim 1, wherein an end portion of the inductor conductor is extended to one of the first and second end surfaces, and wherein at least a portion of each of the outer electrodes is formed on at least a portion of one of the first and second end surfaces.

4. The inductor component according to claim 3, wherein an area percentage of the fallen-off-filler marks in the first and second end surfaces is higher than an area percentage of the fallen-off-filler marks in the first and second main surfaces and an area percentage of the fallen-off-filler marks in the first and second side surfaces.

5. The inductor component according to claim 3, wherein a first edge portion of each of the outer electrodes is located on one of the first and second end surfaces, wherein a second edge portion of each of the outer electrodes is located on the second main surface, and wherein each of the outer electrodes is formed in such a manner as to extend from one of the first and second end surfaces to the second main surface.

6. The inductor component according to claim 5, wherein, when one of the first and second end surfaces is divided into two regions by an imaginary separation line, which is parallel to the first and second main surfaces, an area percentage of the fallen-off-filler marks in a divided region adjacent to the first main surface is higher than an area percentage of the fallen-off-filler marks in a divided region adjacent to the second main surface.

7. A method for manufacturing an inductor component that includes a component body having a substantially rectangular parallelepiped shape, which is defined by first and second main surfaces opposing each other, first and second side surfaces opposing each other, and first and second end surfaces opposing each other, and including a resin and a filler which is present in a state of being dispersed in the resin, an inductor conductor embedded in the component body, and outer electrodes that are electrically connected to the inductor conductor and that are formed on an outer surface of the component body, the method comprising:

fabricating an aggregate component body including a plurality of the component bodies for a plurality of the inductor components, the plurality of component bodies including the inductor conductors embedded in the component bodies and being integrated with one another in a state where the first main surfaces of the component bodies are arranged on one plane and the second main surfaces of the component bodies are arranged on another plane;

dividing the aggregate component body in order to obtain the individual component bodies; and forming of the outer electrodes by using a conductive paste containing a resin in which a conductive metallic powder is dispersed, wherein the dividing of the aggregate component body includes dividing the aggregate component body in such a manner that at least the first and second end surfaces of the component bodies appear, and wherein, in the dividing the aggregate component body, the filler is caused to fall off, so that fallen-off-filler marks, which are formed as a result of the filler falling off, are formed in the first and second end surfaces of the component bodies, and the fallen-off-filler marks are present in a dotted manner in portions of the outer surface that are in contact with the outer electrodes.

8. The method for manufacturing an inductor component according to claim 7, wherein the dividing of the aggregate component body includes performing half cutting on the aggregate component body by using a dicer while leaving a portion of the aggregate component body in a thickness direction of the aggregate component body, and wherein the forming of the outer electrodes includes applying the conductive paste onto the aggregate component body on which the half cutting has been performed.

9. The method for manufacturing an inductor component according to claim 8, wherein a speed of the half cutting using the dicer is set to be 30 mm/s or higher.

* * * * *